US007744478B1

(12) United States Patent
Chelak

(10) Patent No.: US 7,744,478 B1
(45) Date of Patent: Jun. 29, 2010

(54) PORTABLE BOWLING GAME KIT

(76) Inventor: Mark Chelak, 1424 Marielle Dr., Warrington, PA (US) 18976

( * ) Notice: Subject to any disclaimer, the term of this patent is extended or adjusted under 35 U.S.C. 154(b) by 0 days.

(21) Appl. No.: 12/333,354

(22) Filed: Dec. 12, 2008

(51) Int. Cl.
*A63D 3/00* (2006.01)

(52) U.S. Cl. ..... 473/116; 473/162

(58) Field of Classification Search ..... 473/54, 473/113, 115, 162, 116
See application file for complete search history.

(56) References Cited

U.S. PATENT DOCUMENTS

| | | | | |
|---|---|---|---|---|
| 425,249 | A | 4/1890 | Poggenburg | |
| 607,020 | A | 7/1898 | Dodge | |
| 1,259,888 | A | 3/1918 | MacCormack | |
| 1,427,482 | A | 8/1922 | Krauth | |
| 1,503,415 | A | 7/1924 | Fohmann | |
| 1,856,816 | A * | 5/1932 | Luddy | 473/162 |
| 2,384,723 | A * | 9/1945 | Brodzik et al. | 473/159 |
| 3,558,139 | A * | 1/1971 | Brandell et al. | 473/162 |
| 3,727,917 | A * | 4/1973 | MacLean | 473/160 |
| 3,727,918 | A * | 4/1973 | Zawacki | 473/159 |
| 3,944,232 | A * | 3/1976 | Tierney | 473/162 |
| 4,017,084 | A * | 4/1977 | Jeffery | 473/162 |
| 4,596,391 | A * | 6/1986 | Carolan, Jr. | 473/158 |
| 5,401,217 | A * | 3/1995 | Rodriguez-Ferre | 473/54 |
| 5,720,667 | A * | 2/1998 | Tu | 473/162 |
| 5,863,256 | A * | 1/1999 | MacLean et al. | 473/160 |
| 5,937,461 | A * | 8/1999 | Dombrowski et al. | 5/655 |
| 7,294,062 | B2 * | 11/2007 | Ting | 473/162 |
| RE40,754 | E * | 6/2009 | Morton | 5/655 |

* cited by examiner

*Primary Examiner*—William M Pierce
(74) *Attorney, Agent, or Firm*—Howson & Howson LLP

(57) ABSTRACT

A bowling game kit suitable for use on a sand beach comprises a backstop and an elongated flexible rectangular sheet of material connected at one end of the backstop and having one or more target holes adjacent the backstop, which can be in register with buckets situated in depressions formed in the sand. The elongated sheet can be wrapped around the backstop, forming an elongated enclosure in which the buckets and other components can be stored and transported.

4 Claims, 6 Drawing Sheets

PORTABLE BOWLING GAME KIT

CROSS-REFERENCE TO RELATED APPLICATION

This application claims priority on the basis of provisional patent application Ser. No. 29/321,674, filed Aug. 13, 2008.

FIELD OF THE INVENTION

This invention relates to games, and particularly to a bowling game kit primarily for outdoor use.

SUMMARY OF THE INVENTION

Generally, in a bowling game, a ball is propelled manually and rolled from a launching location at one end of a defined path toward a target adjacent an opposite end of the path. In a typical bowling game, the target is a set of pins or similar targets to be toppled when struck by the ball, or one or more openings that the ball can enter, each opening being assigned a score value corresponding to the difficulty of causing the ball to enter the opening.

Bowling games can be set up as permanent installations without difficulty, as in conventional bowling alleys, SKEE BALL arcades, and the like. However, setting up bowling games on sandy beaches and lawns is more difficult because of the need for a smooth surface on which the ball can be rolled. A rigid rolling surface can be sufficiently smooth, but it is not easily transported. Beach sand, on the other hand, exhibits high frictional resistance to a rolling ball, making bowling on a beach difficult, unpredictable, and generally unsatisfactory. Most lawns are also unsatisfactory as bowling surfaces because of non-uniform grass blade lengths and other surface irregularities.

This invention addresses the above-described problems by providing a bowling game kit that can provide a smooth bowling surface on which a ball can be rolled toward a target with reasonable predictability, and which can be readily set up, taken down, and assembled into a compact and easily transported kit.

My bowling game kit comprises an elongated, substantially rectangular, sheet of flexible material, having a top side capable of being disposed substantially in a plane, a bottom side, opposite, elongated, side edges, and opposite first and second ends, the first and second ends being shorter than the side edges. At least one target hole is formed in the sheet at a location adjacent the first end thereof. A substantially rigid backstop is secured to the rectangular sheet adjacent the first end thereof, and extends upward from the sheet on the top side thereof when the top side is disposed substantially in a plane. The backstop extends substantially from one of the elongated side edges to the opposite elongated side edge, and includes a pair of opposite end panels substantially aligned with the respective elongated side edges of the rectangular sheet. The sheet is of sufficient length that it can be wrapped around the backstop to form, with the end panels, an elongated enclosure. At least two mutually engageable fasteners are spaced from each other along the direction of elongation of the sheet, and located at positions such that they can be engaged with each other when the sheet is wrapped around the backstop.

The end panels can both be of the same size and shape, and the mutually engageable fasteners can be disposed on the bottom side of the sheet, and spaced from each other along the direction of elongation of the sheet by a distance substantially equal to the perimeter of one of the end panels.

Flanges can be provided, extending from each end panel toward the opposite end panel, and positioned to support the sheet when the sheet is wrapped around the backstop.

A carrying handle can be secured to the bottom side of the elongated rectangular sheet of flexible material.

A plurality of target holes can be formed in the rectangular sheet adjacent its first end. These openings can have different shapes and sizes. The kit can include a plurality of buckets corresponding in number to the number of target holes, each bucket having a top opening having a shape and size substantially equal to the shape and size respectively of one of the target holes.

The rectangular sheet of flexible material can have a plurality of openings of substantially equal size spaced from one another along each of its opposite, elongated side edges. The kit can include a plurality of anchoring pins, each pin having a shank sized to fit through each of the openings, and a flange larger than each of the openings.

In a version of the bowling game kit adapted for use on a comparatively hard surface such as a lawn, as well as on a softer surface such as beach sand, each pin can have a pair of flanges each flange being larger than each of the openings along the edges of the sheet. In each pin, the flanges are spaced from each other and connected by an intermediate pin section, and each pin has a pair of shank sections extending in opposite directions from each other from its respective flanges. The spacings of the flanges of the pins should be substantially equal, and at least as great as the height of the buckets, which should be uniform.

The backstop can comprise a first rectangular panel extending perpendicularly upward from the elongated sheet. The lengths of end panels, in the direction of the rectangular sheet, when stretched flat, are preferably shorter than the length of the first rectangular panel. The mutually engageable fasteners are preferably both secured to the bottom side of the sheet.

The backstop can also include a base panel extending from the bottom edge of the first panel in a direction substantially parallel to the direction in which the end panels extend from the first panel. The rectangular sheet of flexible material can be attached to the base panel.

The base panel and the end panels can extend from the first panel by substantially the same distance. The end panels can have end panel edges spaced from the first panel and extending parallel to the first panel, and flanges can be provided, each extending from the end panel edge of one end panel toward the other end panel. A gap can be provided between each of the flanges and the base panel to accommodate second end of the flexible sheet, which can be folded into the space between the end panels.

The end panels can also have a second set of flanges on edges of the end panels extending perpendicular to the first pane. Each flange of the second set can extend toward the other end panel.

DETAILED DESCRIPTION OF THE PREFERRED EMBODIMENTS

Figure 1:
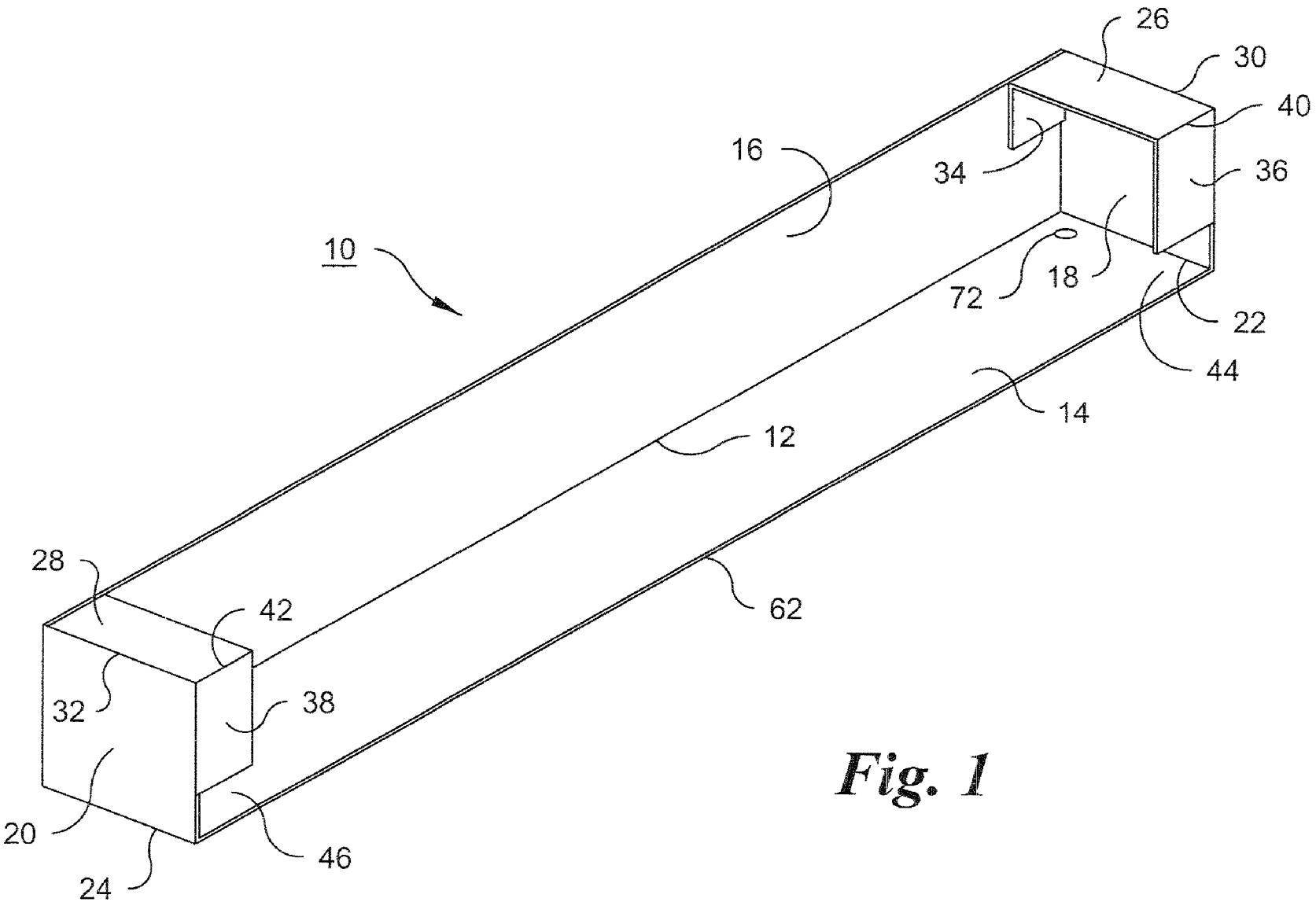
FIG. 1 is a perspective view of a backstop, which is a component of the bowling game kit.

As shown in FIG. 1, backstop 10 is a substantially rigid structure composed of a single sheet of polyethylene or other suitable sheet material folded to form an elongated, rectangular, prism-shaped, box-like structure that is closed at its narrow ends, closed along two adjacent long sides, and open along the other two adjacent sides.

The sheet is bent along line 12 to form an elongated, rectangular bottom panel 14, and an elongated, rectangular, back panel 16, extending upward in perpendicular relation to the bottom panel. End panels 18 and 20 are formed at opposite ends of the backstop by bending the sheet on lines 22 and 24 so that the end panels also extend perpendicularly upward from the bottom panel 14. Top flanges 26 and 28 protrude horizontally toward each other from the upper edges of panels 18 and 20, respectively, being formed by bending along lines 30 and 32. A tab 34 extending downward from flange 26 is secured to the front face of back panel 16 by a suitable adhesive in order to secure panels 14, 16 and 18 in mutually perpendicular relationship. A similar tab (not shown) is provided on flange 28. Finally, flanges 36 and 38 extend downward from fold lines 40 and 42 at the front edges of flanges 26 and 28, and are secured to the end panels by suitable tabs (not shown) and adhesive. Flanges 36 and 38 do not extend all the way to bottom panel 14, leaving gaps 44 and 46 between the bottom panel 16 and the lower edges of flanges 36 and 38.

Although a particular back panel structure has been described, it should be understood that many variations are possible, including, for example, variations in which the end panels meet the back panel along bend lines, variations having different flange structures, variations in which the bottom panel and the end panels do not extend forward from the back panel by the same distance, etc. Additionally, although the backstop is preferably a prism-shaped structure composed of mutually perpendicular, planar, panels and flanges, it is possible to realize the advantages of the invention with backstops having various alternative shapes. As one example, the backstop can have a flat bottom panel and a curved back panel extending upward and forward from the bottom panel, the back panel having an arcuate cross-section subtending an angle of 90°.

Figure 2:
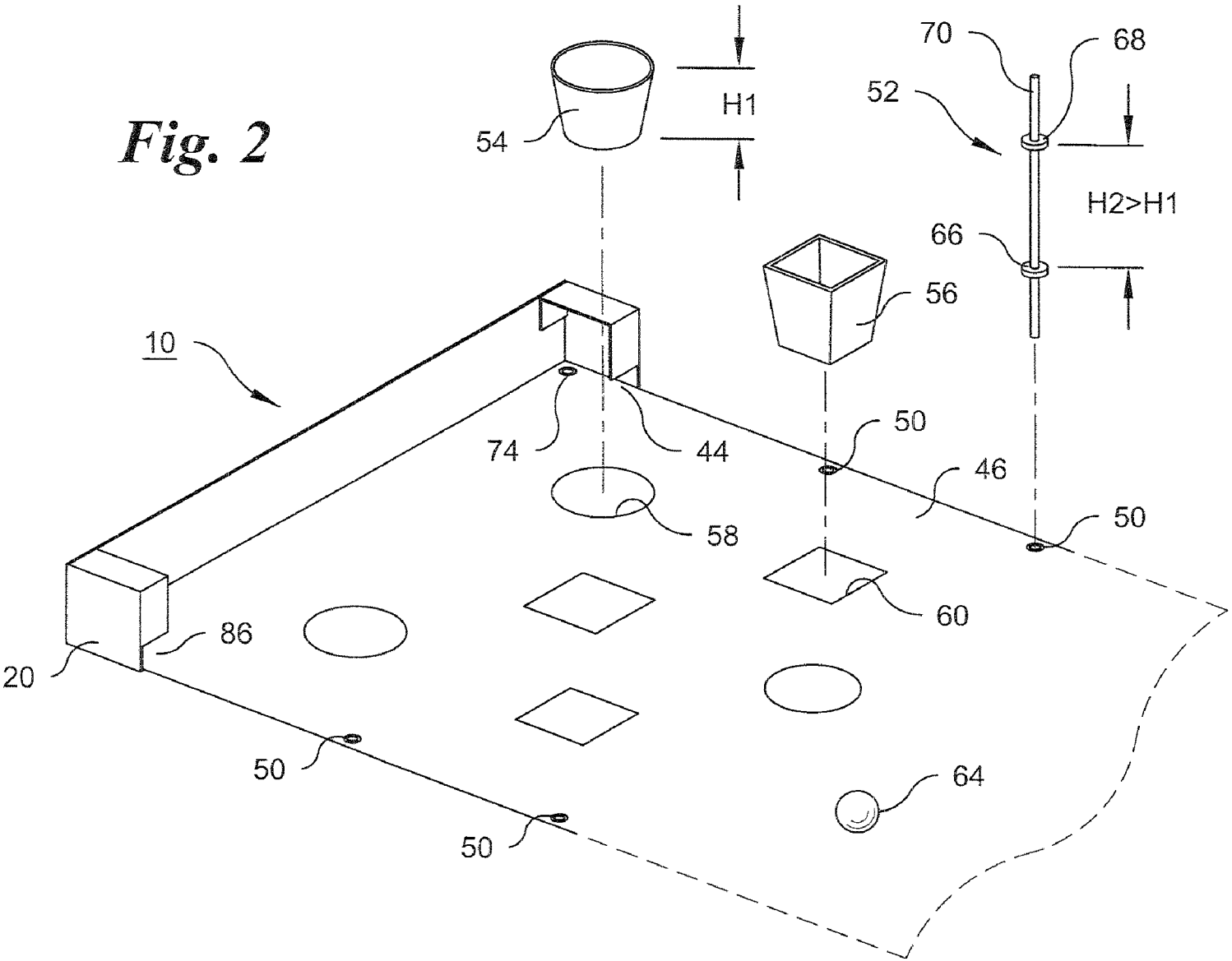
FIG. 2 is an exploded perspective view of the target end of the bowling apparatus, including the backstop, a portion of the flexible sheet, buckets and an anchor pin.

As shown in FIG. 2, an elongated, generally rectangular, flexible sheet 48, which can be formed from a suitable extruded plastic material, fabric, fiber-reinforced plastic material, or the like, has a width approximately equal to the distance between the end panels of the backstop 10. The sheet extends over the bottom panel of the backstop, its edges extending through gaps 44 and 46 of the backstop. The sheet is preferably permanently secured to the backstop by an adhesive layer between the top side of the bottom panel 14 (FIG. 1) and the part of the sheet 48 that overlies bottom panel 14. Grommets 50 are provided at intervals along both long edges of sheet 46 to receive pins 52, which can serve as anchoring pins when the game apparatus is set up on a beach, or alternatively as spacer pins when the game apparatus is set up on a lawn or other similar surface. A supply of such pins can be included with the game kit.

In addition, the game kit can include a set of buckets of various sizes and shapes, such as buckets 54 and 56. These can be conventional plastic top buckets. An array of target holes such as holes 58 and 60, is provided in the sheet, near the backstop but forward of the front edge 62 (FIG. 1) of the bottom panel. The shapes of these openings approximate the shapes of the top openings of the buckets.

When the game is set up on a sand beach, an area of sand corresponding to the area of the sheet 46 when in an unfolded, flat condition, is smoothed using a suitable straight edge device (not shown), which can be supplied as part of the kit. The sheet is placed on the smooth area of sand, and anchored in place by inserting pins 52 through grommets 50. The backstop will be in place at one end of the sheet. Bucket-receiving recesses are formed in the sand in register with the target holes in sheet 46, either by hand or with the aid of a suitable small shovel or similar digging tool. The buckets are then inserted through their corresponding target holes and into the bucket-receiving depressions, with care taken to ensure that the upper edges of the buckets do not protrude through the sheet.

In play, a ball 64, which can be any of a wide variety of suitable balls, is rolled lengthwise along the elongated sheet 46 from the end opposite from the backstop toward the target holes. The target holes can be assigned suitable scores depending on their size, and on their positions in relation to other holes. The rules of play can be set out in printed instructions, or determined by the players themselves.

When the game is set up on a lawn or similar surface where it is either difficult or undesirable to form bucket-receiving recesses, the backstop and the elongated flexible sheet can be spaced by a suitable distance from the surface by inserting the pins 52 into the surface until the lower flanges 66 of the pins contact the surface, arranging the pins in an array corresponding to the grommets. The sheet is then placed on the pins so that the upper portions 70 of the pins extend through the grommets 50 and the grommets rest on upper flanges 68 of the pins. The backstop is similarly supported on pins, and preferably has holes 72 in its bottom panels, which are aligned with grommets 74 in the corners of sheet 46, so that the upper parts 70 of the pins extend through the holes 72 and grommets 74. The pins should be arranged in such a way that the sheet is stretched tight. The buckets can then be placed underneath their corresponding target holes.

The distance H2 between flanges 66 and 68 of the pins should be slightly greater than H1, the height of the buckets, so that, when the sheet is supported on the upper flanges of the pins and stretched tight, the upper edges of the buckets do not protrude through the target holes in the sheet. The game is played on a lawn or similar surface in substantially the same way as it is played when the sheet is set up on beach sand. Preferably, the ball used is a light-weight ball such as a WHIFFLE ball or the like, so that the weight of the ball does not deform the sheet 46 excessively as it is rolled. Some deformation of the sheet under the weight of the ball can be desirable, however, because the deformation of the sheet will cause the ball to follow a curved path, and thereby present an interesting challenge to the player.

The kit will ordinarily include a significant number of parts including, for example one or more balls, six buckets, ten or more pins, and a sand-smoothing straight edge. All of these components can be stowed inside the sheet when the sheet is folded around the backstop.

It is possible to form a complete package by wrapping the flexible sheet around the backstop in any of various ways, and to position fasteners so that they meet when the wrapping of the sheet is completed. However, it is preferable to position the fasteners on the underside of the sheet 46 rather than on the top side, and, at the same time, avoid exposure of the target holes on the outside of the completed package.

An example of a wrapping operation will be described below with reference to FIGS. 3-7.

Figure 3:
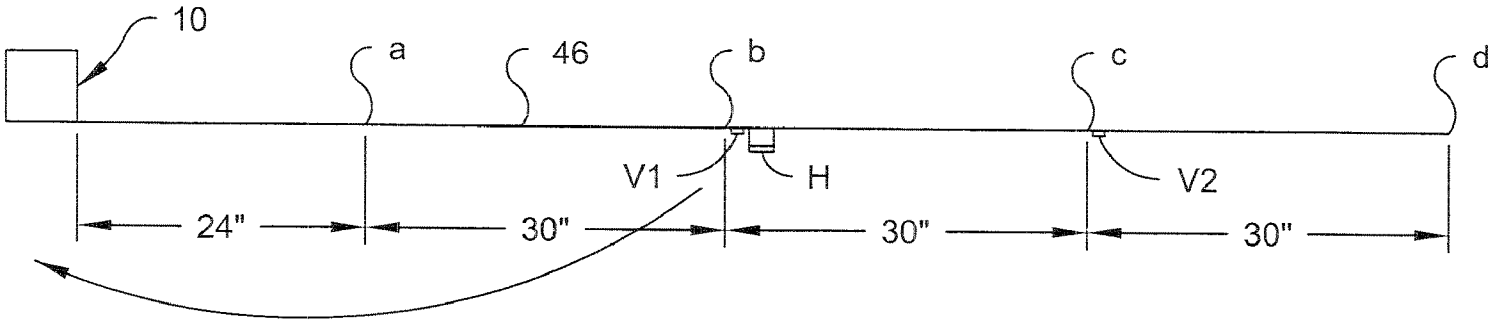
FIG. 3 is a schematic side elevational view of the apparatus in its fully deployed condition.

As shown in FIG. 3, the wrapping operation begins with the sheet 46 in its extended condition. Fold lines in the sheet are indicated by letters a, b and c. These fold lines can be printed on the sheet, or otherwise designated by suitable markings, if desired. The edge of the sheet farthest from the backstop 10 is indicated by the letter d. Typical dimensions of sections of the sheet between fold lines, and between fold line c and edge d are indicated in inches. V1 and V2 are cooperating hook and loop fasteners, such as VELCRO hook and loop fastening strips. It is not important which of V1 and V2 is the hook part and which is the loop part. These fasteners are secured by suitable means, such as sewing or adhesive, to the underside of sheet 46 is order not to interfere with a ball rolling on the top side of the sheet. Fastener V1 is located adjacent fold line b, between fold lines b and c, and fastener V2 is located adjacent fold line c, between fold line c and edge d. A flexible carrying handle H, preferably made of fabric, is provided on the underside of the sheet 46, adjacent fastener V1, between fold lines b and c.

Before beginning the wrapping operation, the miscellaneous parts such as the ball or balls, the buckets, the anchor pins, and the straight edge can be placed inside the backstop.

As shown by the arrow in FIG. 3, the first step in the folding operation is to move line b to a location underneath the back wall of the backstop (panel 16 in FIG. 1). This can be accomplished most easily by grasping the sheet 46 at both ends of fold line a and moving fold line a to a position immediately above fold line c, dragging the backstop toward edge d of the sheet. When this is accomplished, the assembly will be in the condition shown in FIG. 4.

Figure 4:
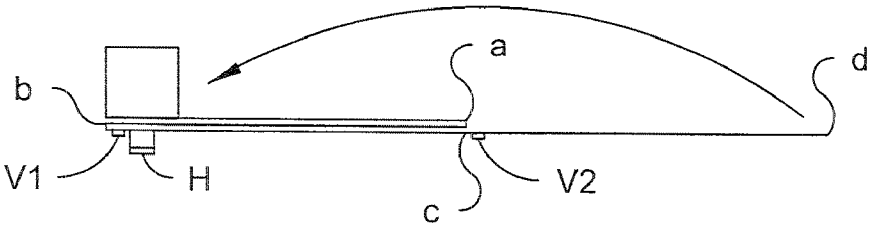
FIGS. 4, 5 and 6 are schematic side elevational views showing successive stages in folding the flexible sheet about the backstop.

The next step is to fold the sheet at fold line C in the manner illustrated by the arrow in FIG. 4. Edge d is moved to a location inside the backstop adjacent the back wall of the backstop. Gaps 44 and 46 (FIGS. 1 and 2) provide clearance allowing the sheet to enter the backstop while remaining flat. The assembly will now be in the condition shown in FIG. 5, in which the sheet is folded into four superimposed layers.

Figure 5:
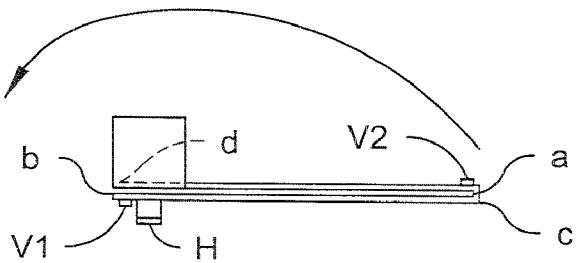
Figure 6:
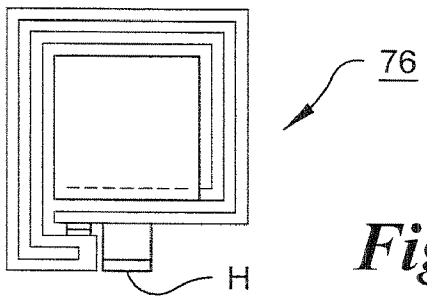

The next step is to wrap the four superimposed layers around the backstop as shown by the arrow in FIG. 5. When this wrapping step is completed, the fasteners V1 and V2 will meet, and can be joined, as shown in FIG. 6, forming a completed package 76 with an externally exposed handle H.

Figure 7:
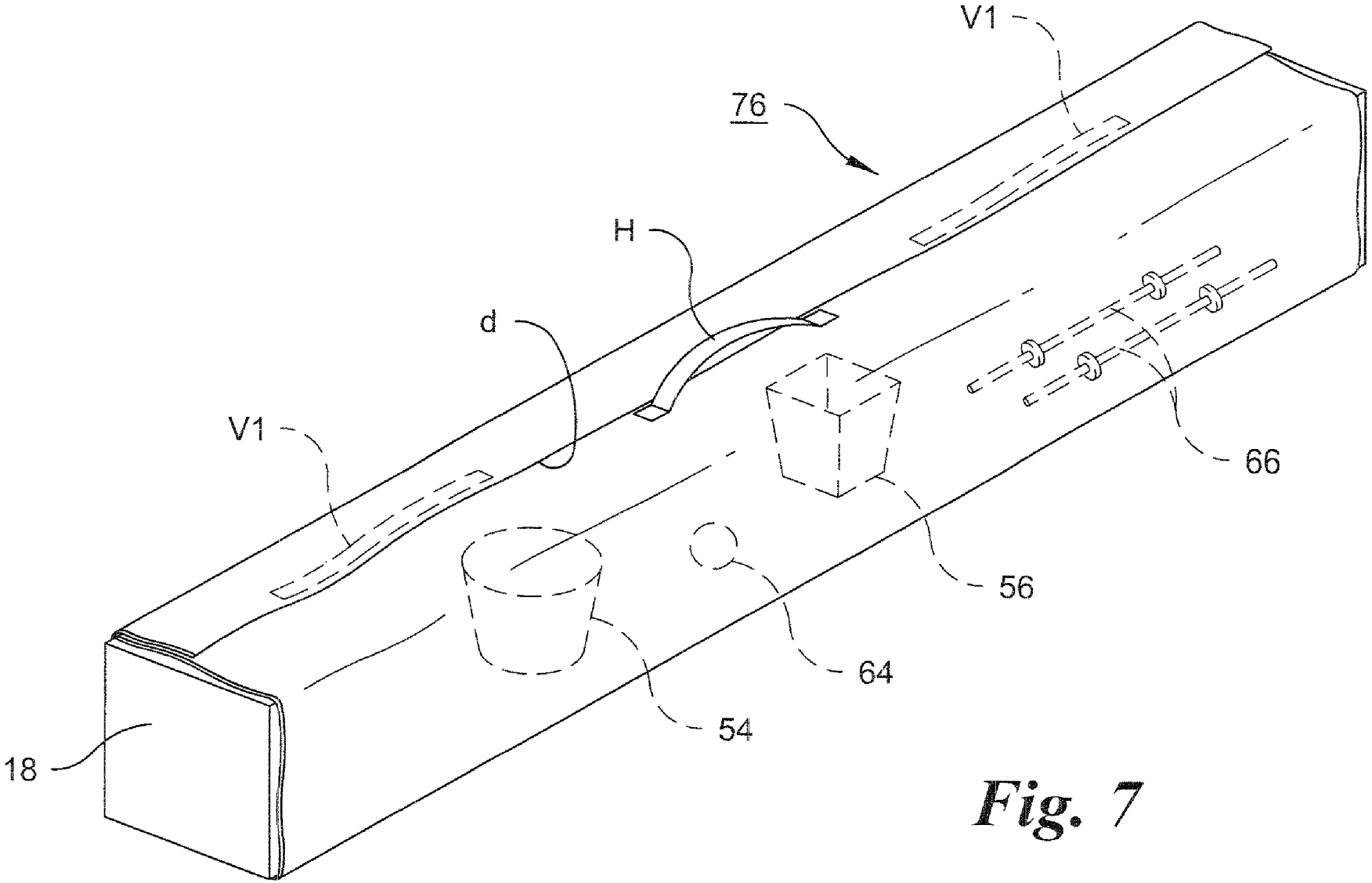
FIG. 7 is a perspective view of the bowling game kit, folded to form an elongated container ready to be transported.

As shown in FIG. 7, the completed package 76 contains the various parts such as buckets 54 and 56, ball 65 and pins 66. The flanges that extend from each end panel of the backstop toward the opposite end panel provide support for the flexible sheet wrapped around the backstop, and ensures that there are no openings large enough to allow the miscellaneous parts to fall out of the package when it is being carried.

In another embodiment, illustrated in FIGS. 8-11, the backstop 80 and sheet 78 are substantially the same as those of the first embodiment. However, the hook and loop fasteners V1 and V2 are positioned differently, on the bottom of a sheet 78. Fastener V1 is located adjacent a fold line b, approximately midway between the ends of the sheet, and the other fastener, V2, is located adjacent a fold line a, and spaced from fastener V1 by a distance approximately equal to the perimeter of an end panel of the backstop 80. Handle H is on the bottom of the sheet 78 on the side of the fold line b toward the backstop, and fastener V1 is on the opposite side of the fold line.

Figure 8:
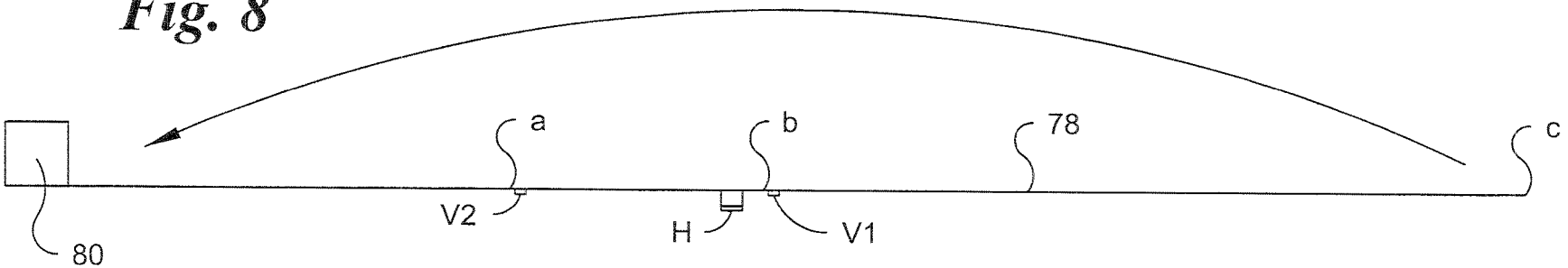
FIG. 8 is a schematic side elevational view showing an alternative embodiment of the game apparatus in its fully deployed condition.
Figure 9:
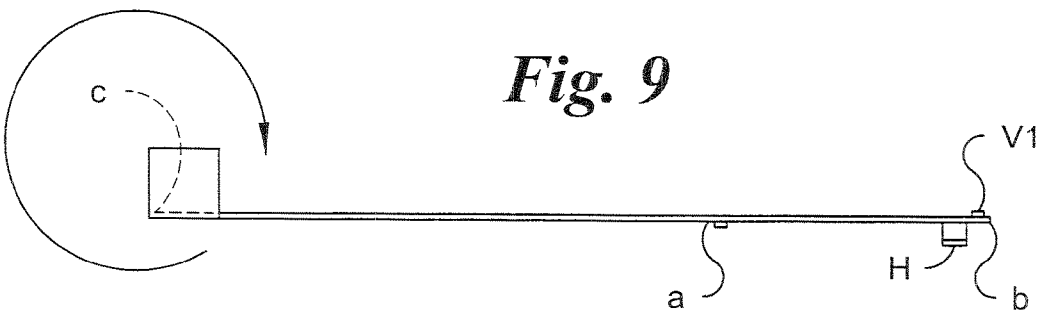
FIGS. 9, 10 and 11 are schematic side elevational views showing successive stages in folding the flexible sheet of the apparatus of FIG. 9 about its backstop.

As shown by the arrow in FIG. 8, the sheet is folded along fold line b adjacent the fastener V1 and its end edge c is brought into the interior of the backstop as shown in FIG. 9, forming a two-layered structure. At this stage, fastener V1 is on the top of the two-layered structure adjacent the fold at fold line b.

Figure 10:
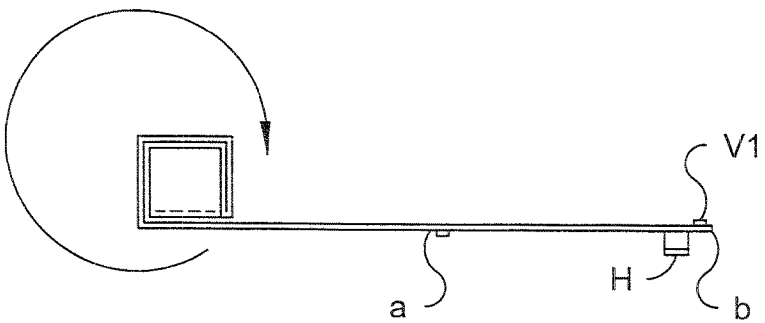
Figure 11:
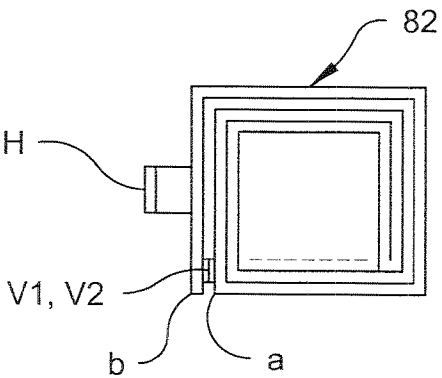
Figure 12:
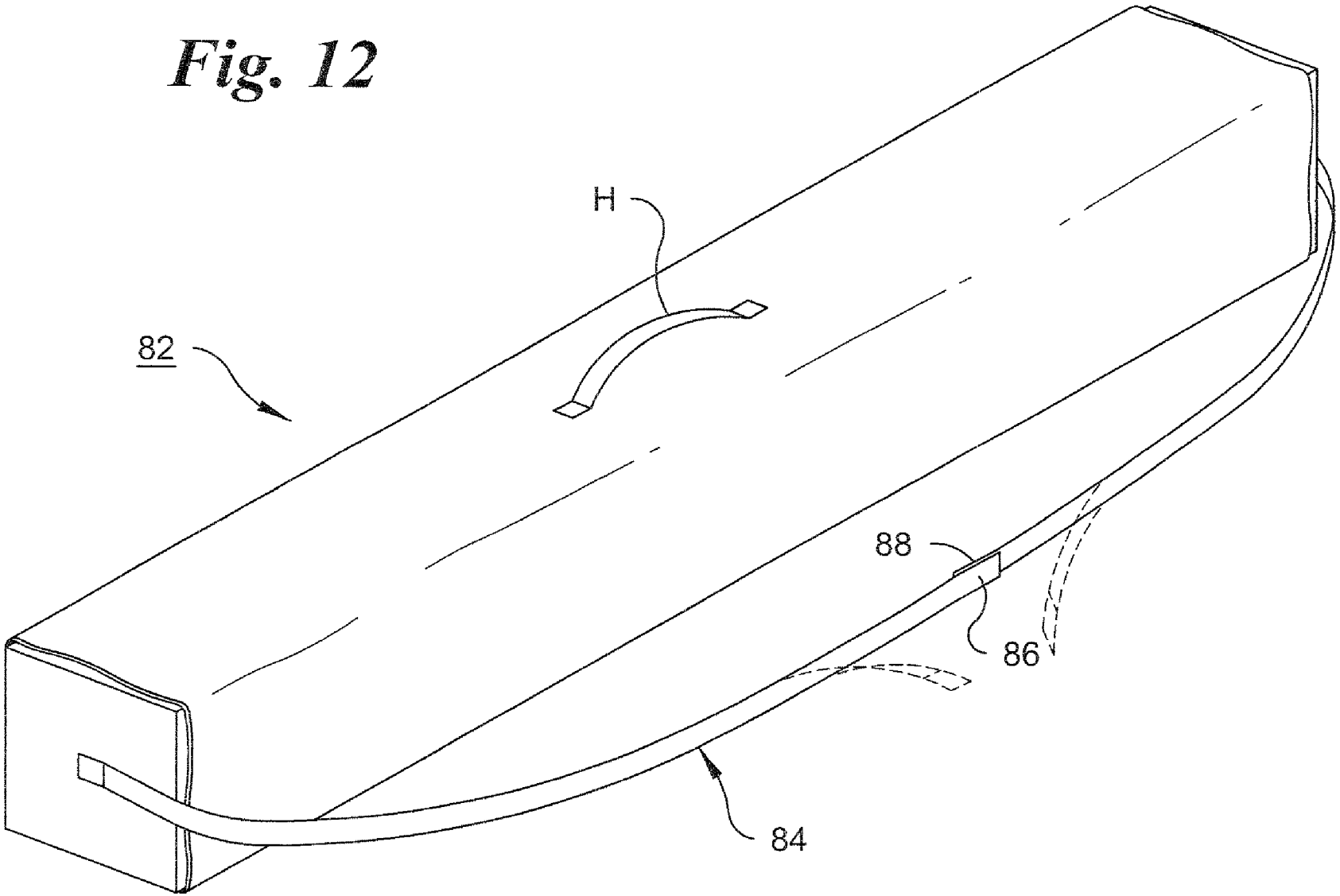
FIG. 12 is a perspective view of the alternative embodiment, folded to form an elongated container ready to be transported.

The backstop is loaded with miscellanous loose game components, and rolled, as shown by the arrows in FIGS. 9 and 10, until the fastener V2 meets fastener V1 as shown in FIG. 11, at which point a completed package 82 is formed. The handle H is exposed for carrying. In addition, as shown in FIG. 12, a carrying strap 84 can be provided, consisting of strap components connected respectively to the end panels of the back stop and having ends 86 and 88 removably connectible to each other by hook and loop fasteners.

Various modifications can be made to the bowling game kits described above. For example, the elongated sheet can be secured directly to the upright portion of the backstop, in which case, the bottom panel of the backstop can be eliminated. In the embodiments specifically described, the fasteners are disposed on the bottom of the flexible sheet, and the sheet is folded so that the fasteners can meet each other when the sheet is wrapped around the backstop. However, it is possible to achieve many of the advantages of the invention in other embodiments. For example, a first fastener can be disposed on the top of the sheet adjacent the end remote from the backstop, and the other fastener can be disposed on the bottom of the sheet and spaced from the first fastener by a distance substantially equal to the perimeter of each of the end panels of the backstop. In that case, the elongated flexible sheet can be wrapped around the backstop without being folded. It is desirable to avoid exposure of the target holes on the outside of the package when the sheet is wrapped around the backstop.

Still other modifications may be made to the apparatus and method described above without departing from the scope of the invention as defined in the following claims.

I claim:

1. A bowling game kit comprising:

an elongated, substantially rectangular sheet of flexible material, said sheet having a top side capable of being disposed substantially in a plane and a bottom side, said sheet also having elongated side edges opposite to each other, and first and second ends opposite to each other, the first and second ends being shorter than said side edges;

at least one target hole formed in said sheet at a location adjacent said first end thereof;

a substantially rigid backstop secured to said rectangular sheet adjacent said first end thereof, the backstop extending upward from said sheet on the top side thereof when the top side is disposed substantially in a plane, and substantially from one said elongated side edge to the opposite elongated side edge, and including a pair of opposite end panels substantially aligned with the respective elongated side edges of the rectangular sheet;

said sheet being of sufficient length that it can be wrapped around the backstop to form, with the end panels, an elongated enclosure;

at least two mutually engageable fasteners, spaced from each other along the direction of elongation of the sheet, said fasteners being located at positions such that they can be engaged with each other when the sheet is wrapped around the backstop, and flanges extending from each end panel toward the opposite end panel, said flanges being positioned to support the sheet when the sheet is wrapped around the backstop.

2. A bowling game kit comprising:

an elongated, substantially rectangular sheet of flexible material, said sheet having a top side capable of being disposed substantially in a plane and a bottom side, said sheet also having elongated side edges opposite to each other, and first and second ends opposite to each other, the first and second ends being shorter than said side edges;

at least one target hole formed in said sheet at a location adjacent said first end thereof;

a substantially rigid backstop secured to said rectangular sheet adjacent said first end thereof, the backstop comprising a first rectangular panel extending perpendicularly from said sheet on the top side thereof when the top side is disposed substantially in a plane, and substantially from one said elongated side edge to the opposite elongated side edge, and a pair of opposite end panels extending perpendicularly from said first panel respectively along said elongated side edges of the rectangular sheet, the lengths of said end panels being shorter than the length of said first rectangular panel;

said sheet being of sufficient length that it can be wrapped around the backstop to form an elongated, substantially prism-shaped, enclosure; and at least two mutually engageable fasteners, both secured to the bottom side of said sheet and spaced from each other along the direction of elongation of the sheet, said fasteners being located at positions such that they can be engaged with each other when the sheet is wrapped around the backstop;

in which the end panels have end panel edges spaced from the first panel and extending parallel to the first panel, and in which the backstop includes flanges each extending from the end panel edge of one end panel toward the other end panel.

3. A bowling game kit comprising:

an elongated, substantially rectangular sheet of flexible material, said sheet having a top side capable of being disposed substantially in a plane and a bottom side, said sheet also having elongated side edges opposite to each other, and first and second ends opposite to each other, the first and second ends being shorter than said side edges;

at least one target hole formed in said sheet at a location adjacent said first end thereof;

a substantially rigid backstop secured to said rectangular sheet adjacent said first end thereof, the backstop comprising a first rectangular panel extending perpendicularly from said sheet on the top side thereof when the top side is disposed substantially in a plane, and substantially from one said elongated side edge to the opposite elongated side edge, and a pair of opposite end panels extending perpendicularly from said first panel respectively along said elongated side edges of the rectangular sheet, the lengths of said end panels being shorter than the length of said first rectangular panel;

said sheet being of sufficient length that it can be wrapped around the backstop to form an elongated, substantially prism-shaped, enclosure; and at least two mutually engageable fasteners, both secured to the bottom side of said sheet and spaced from each other along the direction of elongation of the sheet, said fasteners being located at positions such that they can be engaged with each other when the sheet is wrapped around the backstop;

in which said first panel has a bottom edge, in which the backstop also comprises a base panel extending from the bottom edge of the first panel in a direction substantially parallel to the direction in which said end panels extend from the first panel, in which the rectangular sheet of flexible material is attached to the base panel, in which the end panels have end panel edges spaced from the first panel and extending parallel to the first panel, in which the backstop includes flanges each extending from the end panel edge of one end panel toward the other end panel, and in which a gap is provided between each of said flanges and the base panel.

4. A bowling game kit comprising:

an elongated, substantially rectangular sheet of flexible material, said sheet having a top side capable of being disposed substantially in a plane and a bottom side, said sheet also having elongated side edges opposite to each other, and first and second ends opposite to each other, the first and second ends being shorter than said side edges;

at least one target hole formed in said sheet at a location adjacent said first end thereof;

a substantially rigid backstop secured to said rectangular sheet adjacent said first end thereof, the backstop comprising a first rectangular panel extending perpendicularly from said sheet on the top side thereof when the top side is disposed substantially in a plane, and substantially from one said elongated side edge to the opposite elongated side edge, and a pair of opposite end panels extending perpendicularly from said first panel respectively along said elongated side edges of the rectangular sheet, the lengths of said end panels being shorter than the length of said first rectangular panel;

said sheet being of sufficient length that it can be wrapped around the backstop to form an elongated, substantially prism-shaped, enclosure; and at least two mutually engageable fasteners, both secured to the bottom side of said sheet and spaced from each other along the direction of elongation of the sheet, said fasteners being located at positions such that they can be engaged with each other when the sheet is wrapped around the backstop;

in which the end panels have a first set of end panel edges spaced from the first panel and extending parallel to the first panel, and a second set of end panel edges extending perpendicular to the first panel and spaced from the rectangular sheet of flexible material, in which the backstop includes a first set of flanges each extending from the end panel edge of the first set on one end panel toward the other end panel, and a second set of flanges each extending from the end panel edge of the second set on one end panel toward the other end panel.

* * * * *